US006196152B1

(12) United States Patent
Cacioppo

(10) Patent No.: US 6,196,152 B1
(45) Date of Patent: Mar. 6, 2001

(54) GRID-LIKE CONSTRUCTION BOAT, FOR USE AS A TENDER OR TRIP BOAT

(76) Inventor: Vittorio Cacioppo, Corso Galileo Ferraris, 16, 10121 Turin (IT)

( * ) Notice: Subject to any disclaimer, the term of this patent is extended or adjusted under 35 U.S.C. 154(b) by 0 days.

(21) Appl. No.: 09/529,473

(22) PCT Filed: Jul. 14, 1998

(86) PCT No.: PCT/IT98/00278

§ 371 Date: May 30, 2000

§ 102(e) Date: May 30, 2000

(87) PCT Pub. No.: WO99/20520

PCT Pub. Date: Apr. 29, 1999

(30) Foreign Application Priority Data

Oct. 16, 1997 (IT) ..... MI97U0744

(51) Int. Cl.[7] ..... B63B 7/00

(52) U.S. Cl. ..... 114/354; 114/359

(58) Field of Search ..... 114/325–357, 359

(56) References Cited

U.S. PATENT DOCUMENTS

| | | | | |
|---|---|---|---|---|
| 1,573,958 | * | 2/1926 | Whall | 114/354 |
| 1,857,816 | * | 5/1932 | Cantzler | 114/354 |
| 3,070,816 | * | 1/1963 | Lewis | 114/354 |
| 3,075,207 | * | 1/1963 | Lewis | 114/354 |
| 4,290,157 | * | 9/1981 | Jensen, Jr. | 114/354 |
| 5,615,634 | * | 4/1997 | Gonda | 114/354 |

* cited by examiner

*Primary Examiner*—Jesus D. Sotelo
(74) *Attorney, Agent, or Firm*—Hedman & Costigan, PC

(57) ABSTRACT

An improved grid-like construction boat (1), for use as a tender or trip boat, comprises a central tubular framework, a plurality of tubular elements coupled to the framework and one or more impermeable fabric plies (16, 17) also coupled to the central tubular framework, and encompassing the central tubular framework and tubular elements.

12 Claims, 5 Drawing Sheets

GRID-LIKE CONSTRUCTION BOAT, FOR USE AS A TENDER OR TRIP BOAT

BACKGROUND OF THE INVENTION

The present invention relates to an improved grid-like construction boat, specifically designed for use as a tender or trip boat.

To have, at sea or lake places, a small boat for performing short trips along the coastline, represents an increasing requirement for those persons spending their free time for hobby or relaxation purposes, or for holidays, at the mentioned water places.

Also known is that pleasure boaters find as increasingly comfortable to use small boats, the socalled "tenders" for accessing the shore, while leaving anchored offshore, at will or as required, their large sail or motor boat.

For meeting the above requirements, the prior art provides a lot of rubber boats, either including or not rigid keels, and small boats made of a glass reinforced resin material, aluminium alloys, or wood materials.

While the above small boats solve the mentioned technical problem, they are however affected by several disadvantages.

In fact, said prior boats, either of a rigid or of a inflatable type hull have a comparatively large size. The rigid hull boats, in addition, also have the further drawback that they take up a large portion of the main boat deck; thus suitable and expensive pulley and rope assemblies should be provided on the main boat deck to hold the tenders raised from water and out-board. The inflatable hull boats, in turn, while being less affected by the above drawback, require very tedious inflating and deflating operations.

Another common drawback of said prior small boats is the comparatively great weight thereof, very critical for the user at the start and end of the sailing season, i.e. when the boats are launched onto water or removed therefrom.

Yet another drawback of prior small boats is their high cost, in particular as they are provided, as conventional, with outboard motors.

Furthermore, the maintenance of said boats, with the exception of small aluminium boats, is very complex; this is true both for inflatable and rigid boats, and, in particular, wood and out-board motor boats.

Actually, the first type of boats require a very skilled and accurate labour, while the second boats require a skilled maintenance on their motor assemblies.

It should be apparent that these maintenance requirements represent an additional cost for the users of said boats which, even if small, can not be however eliminated.

The document WO96/39323 discloses a grid-like construction boat according to the preamble of claim 1.

SUMMARY OF THE INVENTION

Accordingly, the main object of the present invention is to overcome the above mentioned drawback of prior small boats.

Thus to achieve the above mentioned aim, the invention, provides an improved grid-like construction boat, specifically designed for use as a tender or a trip boat, which can be series-made at low cost, has a small weight, is reliable, safe, simple to use, with a reduced size and small maintenance requirements.

In brief, the inventive boat is an improved grid-like construction boat, specifically designed for use as a tender and comprises a central tubular framework, a plurality of tubular elements coupled to said central tubular framework, and one or more impermeable fabric plies also coupled to said central tubular framework, and encompassing said central tubular framework and said tubular elements.

The improved grid-like construction boat, specifically designed for use as a tender, according to the invention, is characterized in by the characterizing features of claim 1.

The improved grid-like construction boat, specifically designed for use as a tender or a trip boat according to the invention, provides the following advantages.

The subject boat has a very small weight, if compared to that of small prior boats, with a great advantage from the transport standpoint.

The size of the boat, in its disassembled condition, is very small, thereby it can be easily stored on board of the main boat.

Moreover, the boat according to the present invention can be easily assembled without using assembling tools such as manual air pumps, compressors and the like.

The cost of the subject boat, moreover, is much smaller than that of prior like boats, because of its constructional simplicity, and the possibility of it by small and large series operation.

The inventive boat, furthermore, does not require any maintenance, due to the materials used for making the component pieces forming said boat, thereby allowing the user to achieve great time and money savings.

BRIEF DESCRIPTION OF THE DRAWINGS

Further characteristics, advantages and details of the improved grid-like construction boat, specifically designed for use as a tender or as a trip boat according to the present invention, will become more apparent from the following disclosure, with reference to the accompanying drawings, illustrating, by way of an indicative, but not limitative example, two preferred embodiments thereof.

In the drawings.

DESCRIPTION OF THE PREFERRED EMBODIMENTS

Figure 1:
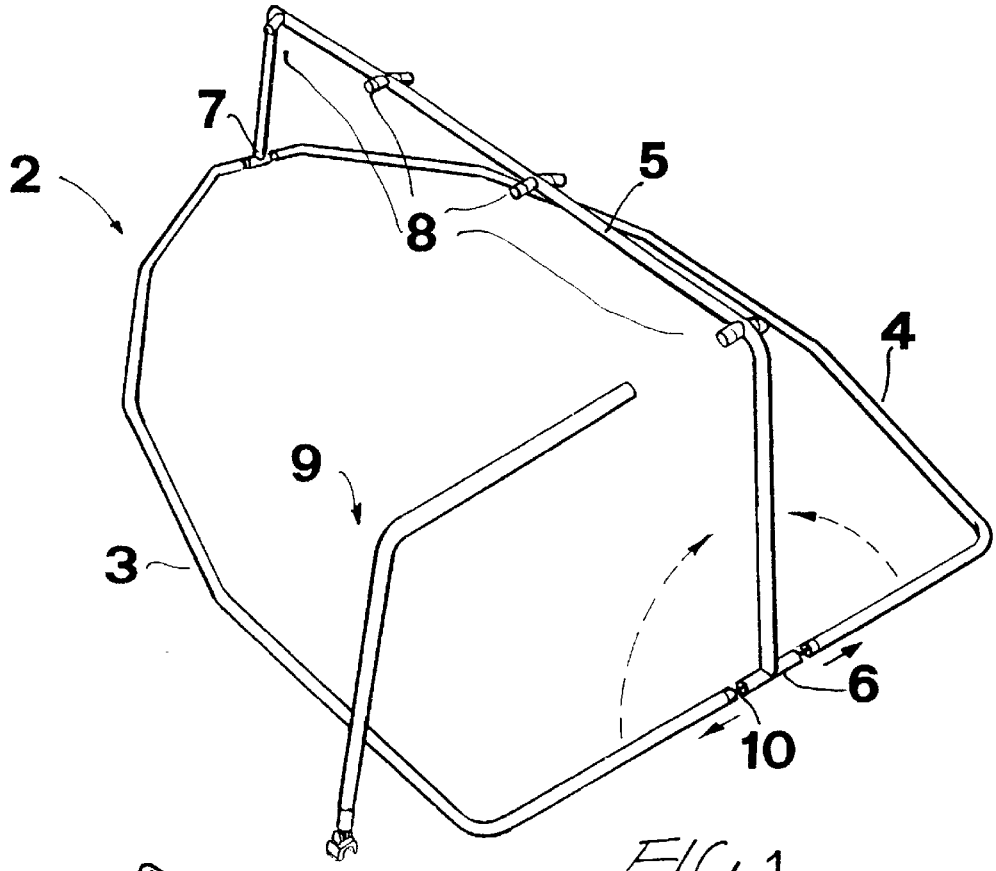
FIG. 1 is a perspective view of the central framework of the improved grid-like construction boat, specifically designed for use as a tender or a trip boat on seas, rivers or lakes, according to the invention.
Figure 2:
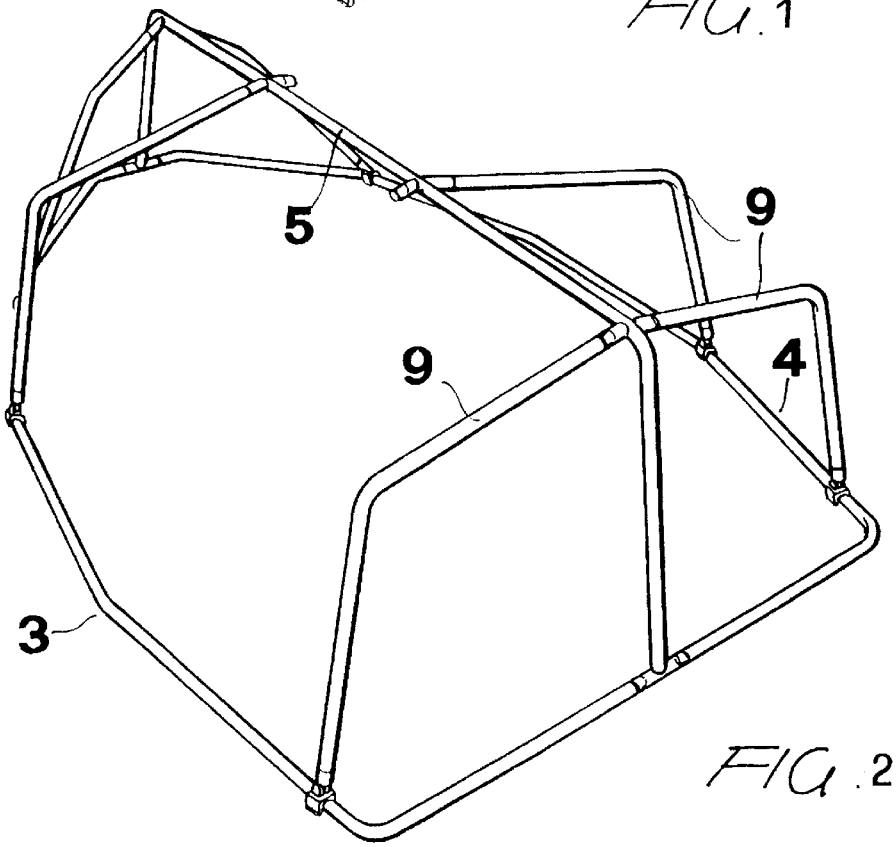
FIG. 2 is perspective view of the central framework, of the boat according to the invention, shown in FIG. 1, to which other structural elements have been coupled.
Figure 3:
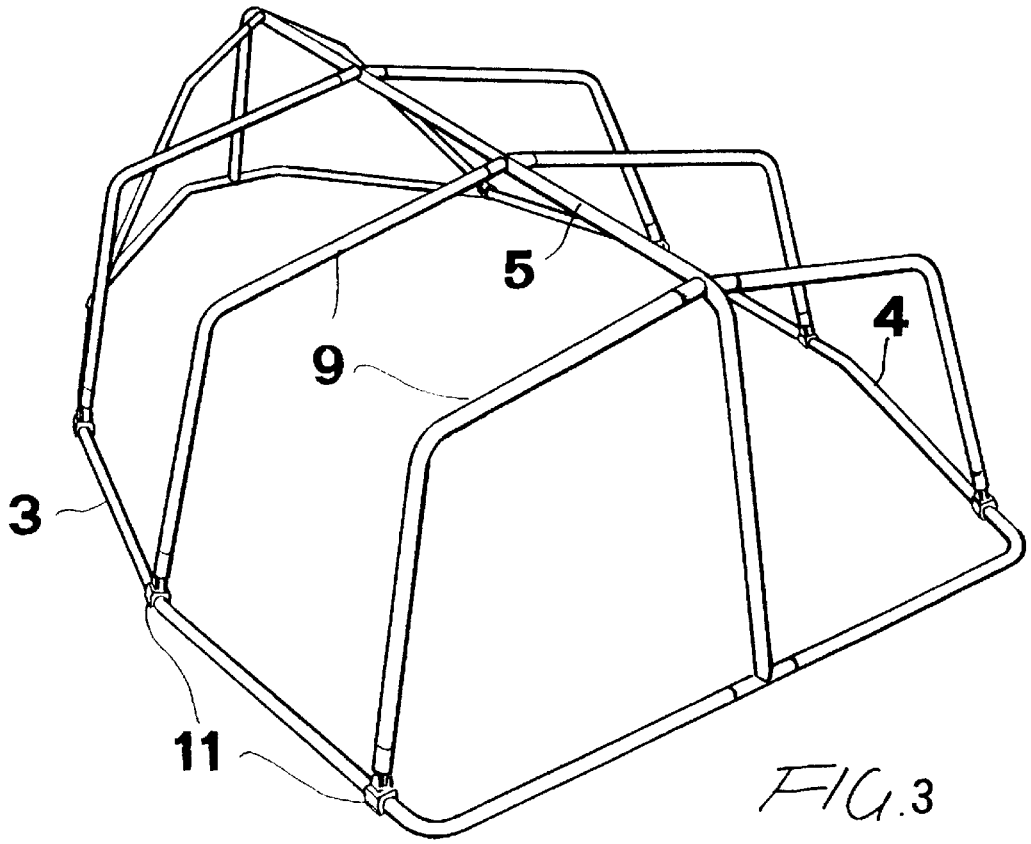
FIG. 3 is a reversed perspective view of the full framework of the improved grid-like construction boat, specifically designed for use as a tender or trip boat according to the invention.
Figure 4:
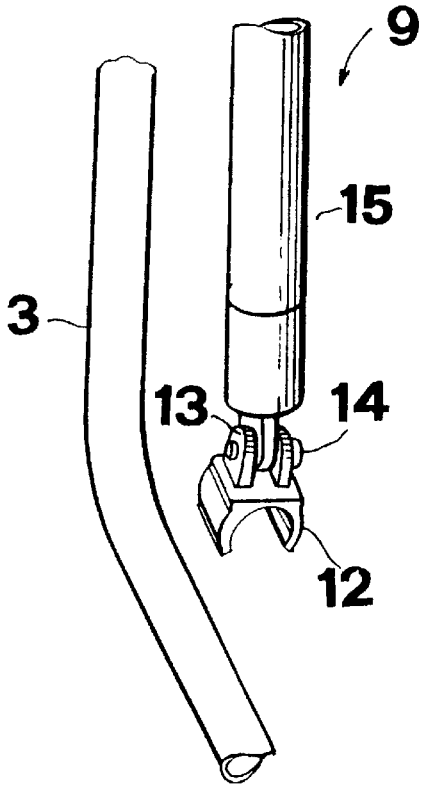
FIG. 4 is a perspective view of a detail of a structural element of the subject boat.
Figure 5:
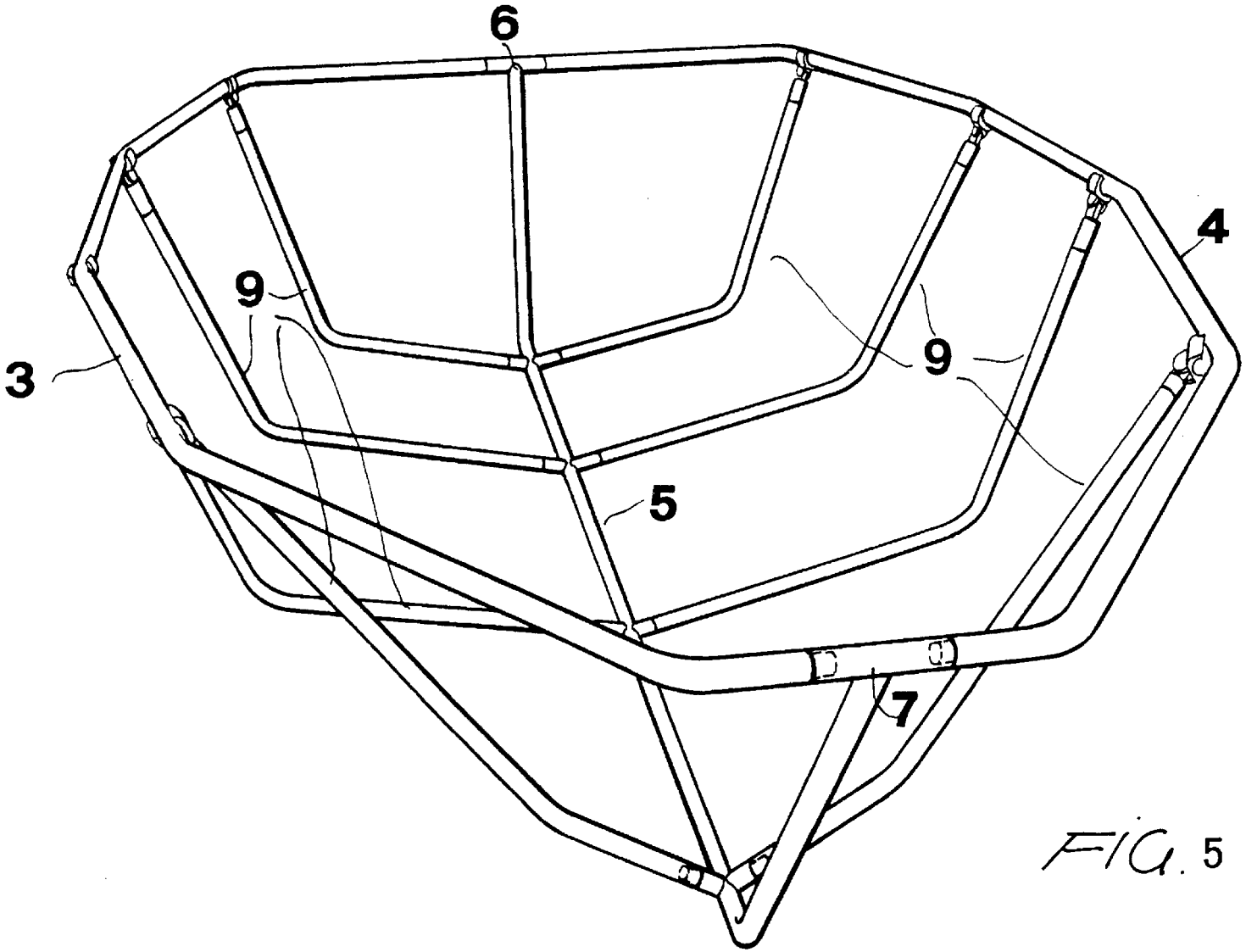
FIG. 5 is a perspective view of the framework shown in FIG. 3.
Figure 6:
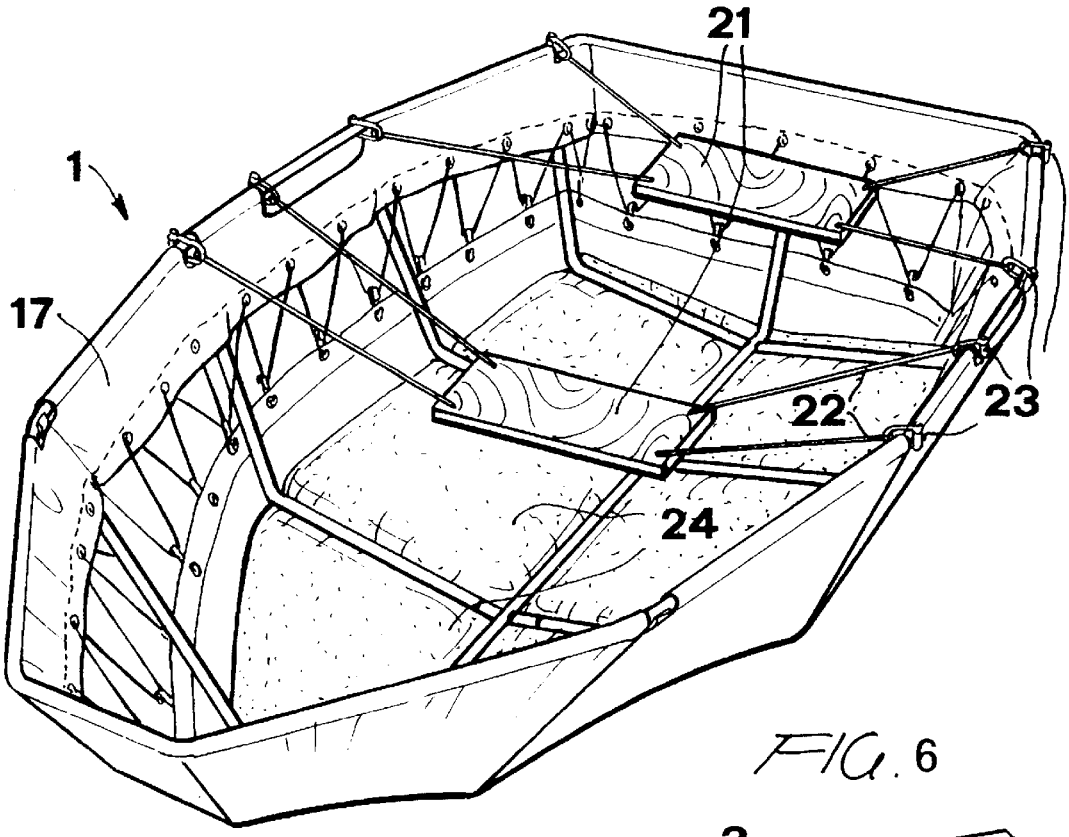
FIG. 6 is a perspective view of the improved grid-like construction, specifically designed for use as a tender or trip boat according to the present invention.
Figure 7:
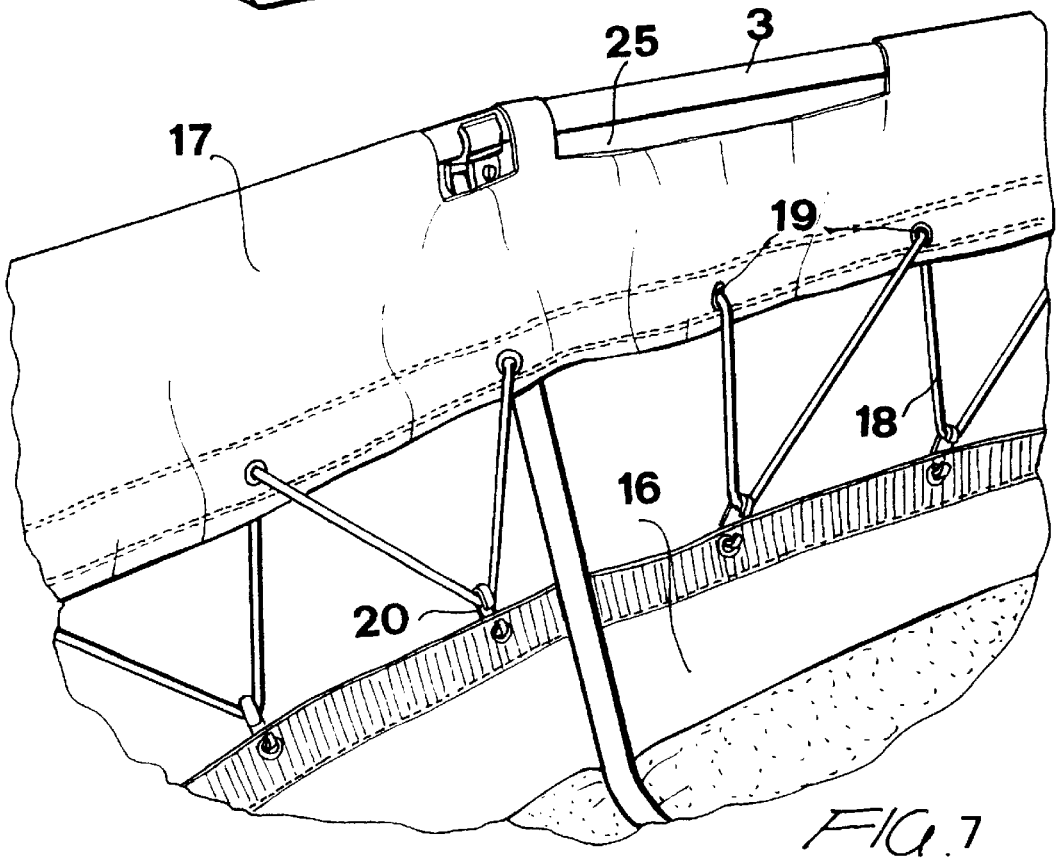
FIG. 7 is a further perspective view of some details of the coating of the boat according to the invention, shown in FIG. 6.
Figure 8:
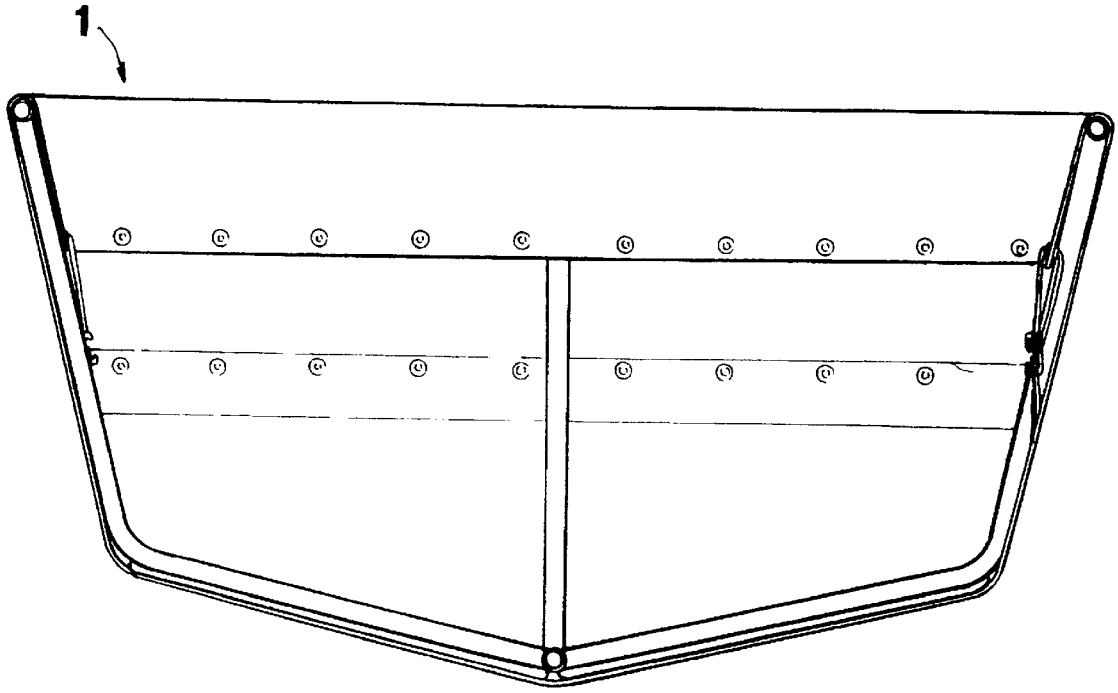
FIG. 8 is a vertical view of the stern of the boat shown in FIG. 6.
Figure 9:
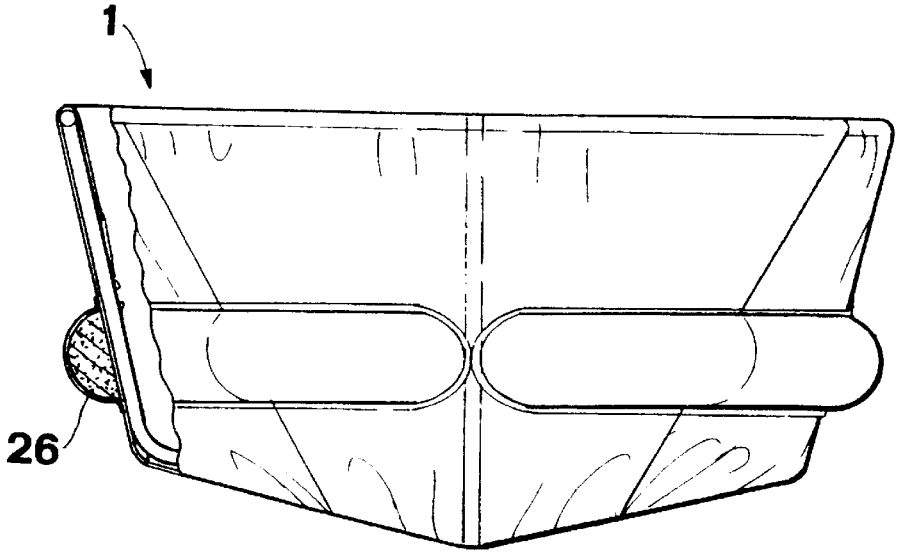
FIG. 9 is a vertical view of the stern of a second embodiment of that same boat.

With reference to the number references of the above disclosed figures, the improved grid-like construction boat 1, specifically designed for small distance trips, and suitable for use as a tender, comprises a central tubular framework 2, including substantially three portions: two perimetric elements 3, 4 and a central element 5.

The perimetrical elements 3, 4, symmetrical with respect to one another, have a polygonal broken line contour having six sides and coupled to the central element 5 by resilient ropes 10, connected to the inner end portions of the elements 3, 4, 5. This connecting system, in particular, allows to greatly reduce the size of the central framework 2, for storing purposes.

As shown, the central element 5 has both its coupling end portions 6, 7 of "T" shape and, substantially through the overall length thereof, is provided with four pairs 8 of tubular plug-in elements, each of which is adapted to engage therein a tubular element 9 in turn connecting the central element 5 to the perimetrical element 3 or 4.

Another embodiment of the inventive boat advantageously provides to further divide the perimetrical elements 3 and 4 and central element 5, said elements being held connected to one another by further resilient ropes or cables: this approach would allow to further reduce the size of the subject boat, in its stored condition.

The mentioned tubular element 9 is provided with a coupling assembly 11, designed to fixedly engage with the perimetral tubular element 3 or 4.

The coupling assembly 11 is advantageously provided with a plastic material portion 12 having a shape complementary to the outer contour of the perimetrical tubular element 3 or 4 and, thereabove, two centrally perforated supporting elements 13 for coupling, by mechanical coupling elements 14, the rod 15 of the tubular element 19. Said mechanical coupling elements can comprise screws, nuts, or like coupling means.

Two impermeable plies 16 and 17 encompass the central tubular framework 2 and tubular elements 9 coupled to said framework, to provide the bottom, stern board or transom and sidewalls of the inventive boat 1.

Both said plies are preferably made of a synthetic impermeable material, and are provided, on the perimeter thereof, with a plurality of holes 19 for coupling said plies to one another by one or more resilient ropes or cables 18.

Hook elements 20, made of a plastic material, are engaged in the holes 19 formed on the perimeter of the bottom ply 16, thereby encompassing the bottom of the boat 1, to hold the ropes 18 suitably tensioned or stretched.

The top ply 17 also encompasses the bottom of the boat 1 above the ply 16, but, since it has a surface larger than that of the ply 16, it can encompass the overall boat hull, included the perimetrical elements 3 and 4. The latter are however held advantageously exposed to view at least at some portions thereof, by suitable openings 25 formed through the ply 17.

In fact, on the above mentioned portions, as suitably provided at a central position, it is possible to assemble the rowlock pins, of known type and not specifically shown in the figures.

On the bottom of the boat according to the invention are moreover provided bottom elements 24, made of a foamed polyethylene material, preferably arranged symmetrically by pairs, whereas, at the centre and toward the boat stern two small seats 21 are provided.

A further embodiment of the boat according to the present invention, advantageously provides to form an integral or single body constituted by the plies 16, 17 and bottom elements 24, in order to provide the boat bottom with a greater stiffness.

The above mentioned seats 21, of rectangular shape, are provided with a throughgoing hole at each corner thereof, therethrough are entrained ropes 22, which, being coupled to spring catch elements 23 fixed to the perimetrical elements 3 or 4, will hold said seats 21 in a raised attitude.

Finally, for obtaining a greater rolling stability, a second embodiment of the boat according to the invention, also provides, at a central position, transversely of said boat, a pair of floating elements 26.

In this connection it should be further pointed out that it would be possible to assemble, on the inventive boat, a small outboard motor, not shown in the figures, said motor being coupled to the perimetrical elements 3 and 4 at the stern side.

It should be apparent that the shape and size of the elements forming the improved grid-like construction boat, specifically designed for use as a tender or a trip boat, according to the invention, can be changed according to the specific requirements, without departing from the above disclosed inventive idea.

The assembling and launching of the subject boat can be carried out in a very easy manner.

In fact, for launching the boat, the central tubular framework 2, which, in its stored condition, owing to the resilient ropes 10, has a very reduced size, is at first extended by bringing the perimetrical elements 3 and 4 to the position shown in FIG. 1, by a rotary movement. Then, said perimetrical elements are firmly connected to the central element 5 at its T-shape endportions 6 and 7.

Then, to said framework 2, eight tubular elements 9 are connected, by the coupling elements 8 and 11 provided on the central element 5 and on said tubular element 9.

Then, the thus made grid-like construction boat 1 is arranged on the two impermeable plies 16 and 17.

The larger size ply 17, will be then entrained on the perimetral elements 3 and 4, while arranging a plurality of hooks 20 on the corresponding plurality of holes 19 perimetrically formed through the ply 16.

Then, one or more ropes 18, joined to one another, will be caused to pass with a zig-zag arrangement, through the holes 19, perimetrically formed through the ply 17, and along the hook elements 20, coupled to the ply 16, so as to firmly join said plies to the already assembled grid-like construction.

Finally, by the ropes 22 and spring catch elements 23, it will be possible to mount the seats 21, the bottom elements 24 being abutted on the bottom of the boat 1, so as to form the limber board thereof. The rowlock pins for the oars are then assembled on the perimetral elements 3 and 4 left exposed through the openings 25 provided through the ply 17; finally, at the stern side, a small outboard motor can be connected to said elements 3 and 4.

Owing to the used materials, the boat 1 according to the invention has a very small weight and, in its assembled condition, it can be launched without any difficulties.

What is claimed is:

1. An improved grid-like construction boat, specifically designed for use as a tender or a trip boat, said boat comprising a central tubular framework (2), a plurality of tubular elements (9) coupled to said central tubular framework (2), and at least one impermeable fabric ply (16, 17), also coupled to said central tubular framework (2), and encompassing said central tubular framework and said tubular elements (9), said central tubular framework (2) being provided with two perimetrical elements (3, 4), coupled by resilient ropes (10) and fixed-joint coupling elements, to a central element (5), said boat (1) comprising moreover two said impermeable plies (16, 17) each provided, along a perimeter thereof, with a plurality of throughgoing holes (19), one of said plies (17) having a larger surface and comprising at least two openings (25).

2. A boat according to claim 1, characterized in that said boat (1) is provided with at least one seat (21), coupled to said central tubular framework (2) by ropes (22) and spring catch elements (23).

3. A boat according to claim 1, characterized in that said boat (1) comprises, as a limber board thereof, a plurality of bottom elements (24), abutted on one of said plies (16, 17), in spaces formed between two adjoining said tubular elements (9).

4. A boat according to claim 3, characterized in that said plies (16, 17) and bottom elements (21) form a single element.

5. A boat according to claim 1, characterized in that said boat (1) comprises a pair of floating elements (26) arranged transversely of a longitudinal middle line of said boat.

6. A boat according to claim 1, characterized in that said central element (5) is provided with two T-shape end portions (6, 7) having an inner configuration complementary to that of the outer end portions of said perimetrical elements (3, 4), in the inside of which are clamped resilient ropes (10), and, along a longitudinal portion thereof, being provided with four pairs of plug-in elements (8), having a complementary inside configuration, at an outer end of said tubular elements (9).

7. A boat according to claim 6, characterized in that said tubular elements (9) are provided with a bottom coupling assembly (11), connected to a rod (11), the other end of which has an outer configuration complementary to the inner configuration of the plug-in element (8) provided on said central element (5).

8. A boat, according to claim 7, characterized in that said coupling assembly (11) provided on said tubular element (9), comprises a bottom portion (12) having a shape complementary to the outer surface of the perimetrical elements (3, 4), above said surface two supporting perforated elements (13) for clamping, by mechanical coupling means (14), the bottom of said rod (15) being provided.

9. A boat according to claim 1, characterized in that said perimetrical elements (3, 4) have a tubular construction and comprise a broken six-side polygonal line, resilient ropes (10) being coupled inside respective end portions of said tubular framework.

10. A boat according to claim 1, characterized in that said two perimetrical elements (3, 4) and central element (5) are divided into a plurality of portions coupled to one another by resilient ropes.

11. A boat according to claim 1, characterized in that on the smaller surface impermeable ply (16) are provided a plurality of hook elements, coupled to the corresponding plurality of holes (19) formed through said ply (16).

12. A boat according to claim 11, characterized in that at least one of said ropes is (18) provided for joining to one another said impermeable plies (16, 17) by engaging through the holes (19) of the larger surface ply (17) and the hook elements (20) coupled to the holes (19) of the smaller surface ply (16).

* * * * *